US011851794B2

(12) United States Patent
Morimoto et al.

(10) Patent No.: US 11,851,794 B2
(45) Date of Patent: Dec. 26, 2023

(54) SEWING DEVICE

(71) Applicant: HONDA MOTOR CO., LTD., Tokyo (JP)

(72) Inventors: Taisuke Morimoto, Tokyo (JP); Yosuke Ikadai, Tokyo (JP); Kazuma Nakayama, Tokyo (JP); Tohru Takamura, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 122 days.

(21) Appl. No.: 17/676,837

(22) Filed: Feb. 22, 2022

(65) Prior Publication Data

US 2022/0316118 A1 Oct. 6, 2022

(30) Foreign Application Priority Data

Mar. 31, 2021 (CN) ..... 202110344293.5

(51) Int. Cl.
*D05B 69/30* (2006.01)
*D05B 69/10* (2006.01)

(52) U.S. Cl.
CPC ..... *D05B 69/30* (2013.01); *D05B 69/10* (2013.01)

(58) Field of Classification Search
CPC ..... D05B 69/00; D05B 69/02; D05B 69/08; D05B 69/10; D05B 69/36; D05B 57/30; D05B 57/32
See application file for complete search history.

(56) References Cited

U.S. PATENT DOCUMENTS 4,373,458 A * 2/1983 Dorosz ..... D05C 7/00 112/470.13
4,817,543 A * 4/1989 Fischer ..... D05C 7/00 112/470.01
4,926,769 A * 5/1990 Upmeier ..... D05B 3/02 112/309

(Continued)

FOREIGN PATENT DOCUMENTS

CN 101581014 A 11/2009
CN 205062413 U 3/2016

(Continued)

OTHER PUBLICATIONS

Office Action issued in the CN Patent Application No. 202110344293.5, dated Aug. 31, 2023.

*Primary Examiner* — Nathan E Durham
(74) *Attorney, Agent, or Firm* — CKC & Partners Co., LLC

(57) ABSTRACT

A sewing device includes a power source, an input shaft to which a driving force from the power source is transmitted, an output shaft that outputs the driving force transmitted to the input shaft, and a transmission mechanism that transmits the driving force from the input shaft to the output shaft, in which the transmission mechanism includes a first gear that is provided in the output shaft and rotates integrally with the output shaft, a second gear that meshes with the first gear, an intermediate shaft that rotates integrally with the second gear, and a timing belt stretched between the input shaft and the intermediate shaft, in which the second gear is disposed to be movable in a circumferential direction of the first gear. As a result, loosening of the timing belt can be adjusted in a compact configuration.

3 Claims, 6 Drawing Sheets

(56) References Cited

U.S. PATENT DOCUMENTS

| | | | | |
|---|---|---|---|---|
| 2013/0008362 | A1* | 1/2013 | Wenzel | D05B 57/32 112/53 |
| 2019/0360141 | A1* | 11/2019 | Ikadai | D05B 1/10 |
| 2021/0164141 | A1* | 6/2021 | Arai | D05B 1/14 |

FOREIGN PATENT DOCUMENTS

| | | | |
|---|---|---|---|
| CN | 110191984 | A | 8/2019 |
| DE | 102017003376 | A1 | 10/2018 |
| JP | S6394017 | A | 4/1988 |
| JP | 3125480 | B2 | 1/2001 |
| JP | 2002054703 | A | 2/2002 |
| JP | 2011036403 | A | 2/2011 |
| JP | 6804563 | B2 | 12/2020 |

* cited by examiner

SEWING DEVICE

This application is based on and claims the benefit of priority from Chinese Patent Application No. 202110344293.5, filed on 31 Mar. 2021, the content of which is incorporated herein by reference.

BACKGROUND OF THE INVENTION

Field of the Invention

The present invention relates to a sewing device.

Related Art

A single chain stitch sewing device that forms stitches in a workpiece to be sewed using a needle and a looper has been known (see Patent Document 1). In the sewing device, rotational motion of a motor is transmitted to the needle via a motion conversion mechanism that converts the rotational motion into reciprocating motion, while the rotational motion is transmitted to the looper via a rotation transmission mechanism including a plurality of pulleys and a timing belt. The needle performs a reciprocating operation to penetrate the workpiece to be sewed from its one surface side to the other surface side and return to the one surface side again, while the looper performs a rotation operation on the other surface side of the workpiece to be sewed. A needle reciprocating operation for the needle having an insertion hole provided on its needle tip side into which a sewing thread has been inserted to repeatedly penetrate sequential sites of the workpiece to be sewed and a sequential feeding operation of the workpiece to be sewed are synchronously repeated. The sewing thread that has penetrated the workpiece to be sewed from the one surface side to the other surface side using the needle draws a predetermined loop while the looper rotates by skimming the sewing thread with its claw. The sewing thread that has penetrated the workpiece to be sewed then passes through the loop thus drawn, to draw a loop again. As a result, predefined stitches that are continuous because the loop is entangled are formed on the other surface side of the workpiece to be sewed. The rotation transmission mechanism including the pulleys and the timing belt is provided with an adjustment mechanism for adjusting loosening of the timing belt. As the adjustment mechanism, a tensioner that presses a tension roller against the timing belt to adjust a path length of the timing belt is general. In a rotation transmission mechanism in which one pulley and the other pulley are coupled to each other with a timing belt, an adjustment mechanism adapted to adjust an inter-axis distance between an axis of a motor coaxial with the one pulley and an axis of the other pulley to adjust loosening of the timing belt has been known (See Patent Document 2 and Patent Document 3).

Patent Document 1: Japanese Patent No. 6804563
Patent Document 2: Japanese Patent No. 3125480
Patent Document 3: Japanese Unexamined Patent Application, Publication No. 2011-036403

SUMMARY OF THE INVENTION

In the sewing device as disclosed in Patent Document 1, when the general tensioner using the tension roller is applied to the rotation transmission mechanism to the looper, a post bed as a support unit of the looper increases in size so that a detail of the workpiece to be sewed is difficult to sew. As disclosed in Patent Document 2 and Patent Document 3, a method for adjusting an attachment position of a motor that is itself a heavy object is unsuitable for fine adjustment related to the loosening of the timing belt.

The present invention has been made in view of the above-described circumstances, and is directed to providing a sewing device capable of adjusting loosening of a timing belt in a compact configuration.

(1) A sewing device (e.g., a sewing device 1, described below) including a sewing mechanism that forms stitches in a workpiece to be sewed, the sewing device including a power source (e.g., a motor 5, described below), an input shaft (e.g., a lower shaft 12, described below) to which a driving force from the power source is transmitted, an output shaft (e.g., a rotation shaft 21, described below) that outputs the driving force transmitted to the input shaft, and a transmission mechanism (e.g., a transmission mechanism 35, described below) that transmits the driving force from the input shaft to the output shaft, in which the transmission mechanism includes a first gear (e.g., a driven gear 20, described below) that is provided in the output shaft and rotates integrally with the output shaft, a second gear (e.g., an intermediate gear 19, described below) that meshes with the first gear, an intermediate shaft (e.g., an intermediate shaft 16, described below) that rotates integrally with the second gear, and a timing belt (e.g., a timing belt 18, described below) stretched between the input shaft and the intermediate shaft, in which the second gear is disposed to be movable in a circumferential direction of the first gear.

(2) The sewing device in the foregoing item (1) further including: a support member (e.g., a turning support plate 24, 24*a*, 24*b*, described below) that supports the intermediate shaft at its end portion; a fixing bolt (e.g., a first fixing bolt 27 and a second fixing bolt 28, described below) in one of the support member and a predetermined attaching portion (e.g., an attaching portion 29, described below) that attaches the support member, the fixing bolt being disposed to fix the support member to the attaching portion; and a circular arc-shaped long hole (e.g., a first long hole 25 and a second long hole 26, described below) in the other of the support member and the attaching portion, the fixing bolt being inserted in the circular arc-shaped long hole, the circular arc-shaped long hole having its own center of curvature coinciding with a rotation center of the first gear; in which the support member is attached to the attaching portion to be turnable with the center of curvature of the long hole as its axis.

(3) The sewing device in the foregoing item (2), in which the support member has a circular arc-shaped contact surface (e.g., a contact surface 30, described below) in the input shaft side, its own center of curvature coincides with the rotation center of the first gear, and the attaching portion has a load receiving surface (e.g., a load receiving surface 31, described below) that is formed in a circular arc shape having its own center of curvature coinciding with the rotation center of the first gear and slidably contacts the contact surface.

In the sewing device described in the item (1), loosening (tension) of the timing belt can be adjusted without changing respective positions of the input shaft and the output shaft in a compact configuration.

In the sewing device described in the item (2), the tension of the timing belt can be easily adjusted by moving the support member along the long hole.

In the sewing device described in the item (3), a load due to change in the tension of the timing belt can be received by the load receiving surface of the attaching portion.

DETAILED DESCRIPTION OF THE INVENTION

Figure 1:
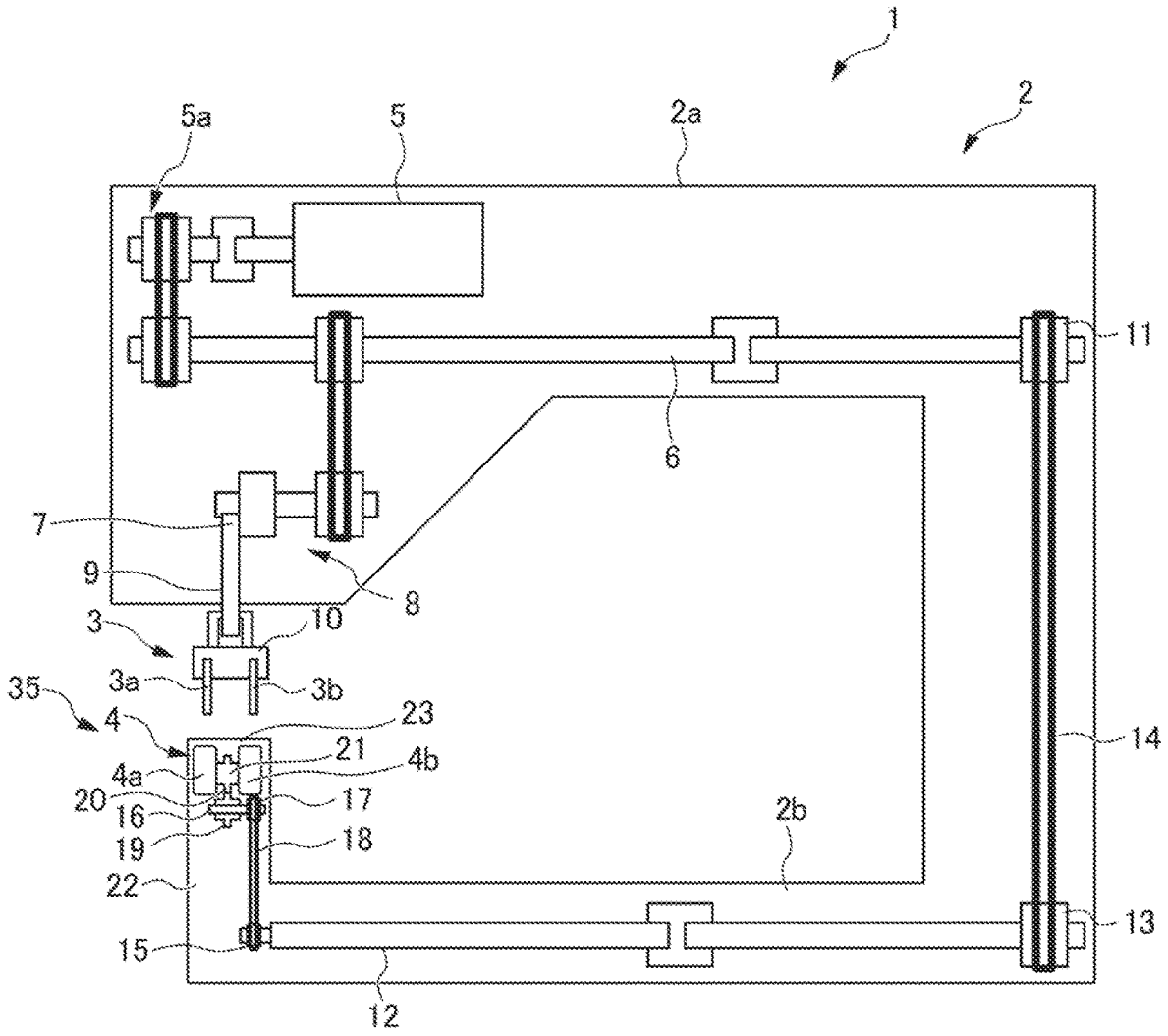
FIG. 1 is a schematic view illustrating a sewing device according to an embodiment of the present invention.

An embodiment of the present invention will be described below with reference to the drawings. FIG. 1 is a schematic view illustrating a sewing device 1 as the embodiment of the present invention. A sewing device main body 2 in the sewing device 1 is integrally configured with an arm portion 2*a* and a bed portion 2*b* being continuous in their respective connection portions. The arm portion 2*a* is provided with a motor 5 as a power source related to respective operations of a sewing needle 3 and a looper 4.

Rotational motion of an upper shaft 6 connected to an axis of the motor 5 via a general rotation transmission mechanism 5*a* including a belt and a pulley, for example, is transmitted to the needle 3 upon being converted into reciprocating motion by a motion conversion mechanism 8 including a crank mechanism 7. The needle 3 is attached to an end portion of a sliding rod 9 as a member for outputting the reciprocating motion in the motion conversion mechanism 8.

The needle 3 includes two needles 3*a* and 3*b* attached to a needle holder 10 in parallel in such a manner that their respective needle tips are oriented in the same direction, and the needle holder 10 is attached to the end portion of the sliding rod 9. Each of the two needles 3*a* and 3*b* forms stitches in a workpiece to be sewed (not illustrated) by similar reciprocating motion with a thread inserted into its thread-passing hole.

The rotational motion of the upper shaft. 6 is transmitted to a lower shaft 12 in the bed portion 2*b* by a power transmission belt 14 stretched between an upper shaft output pulley 11 provided in the upper shaft 6 and a lower shaft input pulley 13 provided in the lower shaft 12. The rotational motion transmitted to the lower shaft 12 is transmitted to an intermediate shaft 16 by a timing belt 18 stretched between a lower shaft output pulley 15 provided in the lower shaft 12 and an intermediate shaft input pulley 17 provided in the intermediate shaft 16.

The rotational motion transmitted to the intermediate shaft 16 is transmitted to an driven gear 20 meshing with an intermediate gear 19 provided in the intermediate shaft 16, and a rotation shaft 21 provided with the driven gear 20 rotates. The rotation shaft 21 rotates the looper 41. A portion that transmits a driving force from the lower shaft (input shaft) 12 to the rotation shaft (output shaft) 21 is referred to as a transmission mechanism 35, as described below.

The looper 4 is provided in a post bed 22 having a substantially hollow prism shape protruding toward the needle tip of the needle 3 from the bed portion 2*b* in the sewing device main body 2. The post bed 22 is flat on its protrusion end side, to form a mount 23 on which the workpiece to be sewed (not illustrated) is mounted.

In one embodiment, the mount 23 is formed at a top of a casing 34, described below, which pivotably supports the rotation shaft. 21 in the looper 4 and covers and protects a predetermined portion of the looper 4. The mount 23 is provided with an opening (not illustrated in FIG. 1) through which the needles 3*a* and 3*b* can enter or leave a hollow interior of the post bed 22.

The looper 4 is configured such that two loopers 4*a* and 4*b* pivotably supported on the common rotation shaft 21 in the same rotation phase overlap each other in an axial direction with the driven gear 20 sandwiched therebetween. The rotation shaft 21 is provided at a position facing a rear surface of the mount 23 in the post bed 22. The loopers 4*a* and 4*b* that rotate by the rotation shaft 21 are positioned to face the protrusion end side of the post bed 22 to respectively correspond to the two needles 3*a* and 3*b*. Both the two loopers 4*a* and 4*b* turn around the common rotation shaft 21, and similarly function. In the following description, the two loopers 4*a* and 4*b* are typically referred to as the looper 4, as needed.

Figure 2:
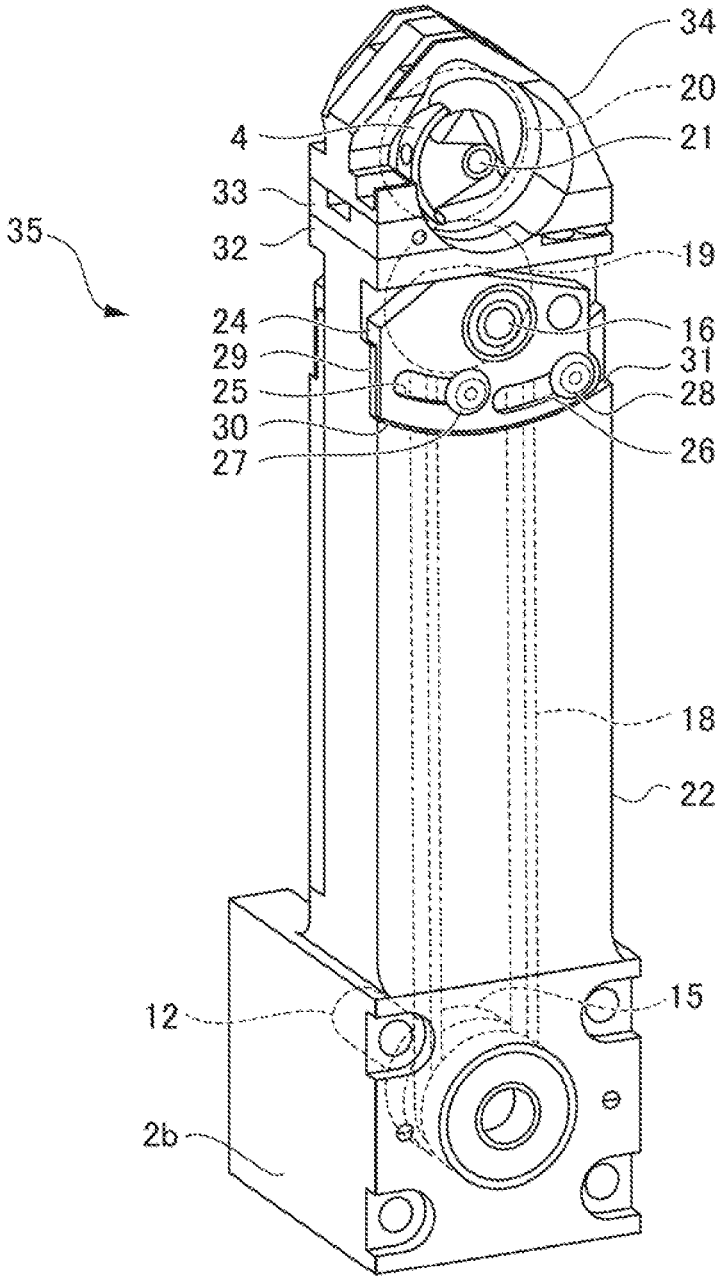
FIG. 2 is a diagram illustrating one state of a driving force transmission mechanism from a lower shaft to a looper in the sewing device illustrated in FIG. 1.

FIG. 2 is a diagram illustrating one state of a driving force transmission mechanism from the lower shaft 12 to the looper 4 in the sewing device 1 illustrated in FIG. 1. The timing belt 18 arranged in the post bed 22 raised from the bed portion 2*b* is stretched from the lower shaft output pulley 15 in the lower shaft 12 to the intermediate shaft input pulley 17 in the intermediate shaft 16 so that a driving force is transmitted from the lower shaft 12 to the intermediate shaft 16. The driving force transmitted to the intermediate shaft 16 is transmitted to the driven gear 20 as a first gear meshing with the intermediate gear 19 as a second gear provided in the intermediate shaft 16. As a result, the rotation shaft 21 provided with the driven gear 20 rotates. The rotation shaft 21 is an output shaft that outputs a rotation driving force from the lower shaft 12 as an input shaft to the looper 4.

The intermediate shaft 16 has its shaft end fixed to a turning support plate 24 as a support member. The turning support plate 24 includes a first long hole 25 and a second long hole 26 as two circular arc-shaped long holes that respectively have centers of curvature coinciding with an axis of the rotation shaft 21 and have different radii of curvature. Into the first long hole 25 and the second long hole 26, a first fixing bolt 27 and a second fixing bolt 28 corresponding thereto are respectively inserted. The first fixing bolt 27 and the second fixing bolt 28 are fastened to an attaching portion 29 as a strength member provided in an outer shell of the post bed 22.

The turning support plate 24 has a circular arc-shaped contact surface 30 having its own center of curvature coinciding with a rotation center of the driven gear 20 on the lower shaft 12 side spaced apart from a site to which the shaft end of the intermediate shaft 16 is fixed. The attaching portion 29 in the post bed 22 is provided with a load receiving surface 31 as a circular arc-shaped sliding surface having its own center of curvature coinciding with the rotation center of the driven gear 20 (the axis of the rotation shaft 21) to correspond to the contact surface 30. Even if a large load may be applied to the turning support plate 24 upon change in tension of the timing belt 18, the contact surface 30 of the turning support plate 24 is supported by the load receiving surface 31.

The turning support plate 24 is movable in a predetermined range in such a manner as to be guided by the first long hole 25 and the second long hole 26, respectively, with the first fixing bolt 27 and the second fixing bolt 28 loosened. In a movement process of the turning support plate 24, the contact surface 30 turns with the axis of the rotation shaft 21 as a common center of curvature of the first long hole 25 and the second long hole 26, i.e., the center of the driven gear 20 used as its center. The position of the turning support plate 24 is determined at a position where the first fixing bolt 27 and the second fixing bolt 28 are tightened.

In a state illustrated in FIG. 2, the turning support plate 24 is at a limit position where it has turned in a clockwise direction in a front view. At this limit position, the first fixing bolt 27 contacts a right end of the first long hole 25, and the second fixing bolt 23 contacts a right end of the second long hole 26.

On the other hand, a top of the outer shell of the post bed 22 constitutes a flat portion 32. A base portion 33 is provided just above the flat portion 32. A casing 34 that supports the looper 4 rotated by the rotation shaft 21 and covers and protects a predetermined portion of the looper 4 is fixed on the base portion 33.

For a driving force transmission system to the looper 4 in the casing 34, a transmission path dating back to a source of a driving force from the looper 4 side is illustrated as follows. Looper 4→rotation shaft (output shaft) 21→driven gear (first gear) 20→intermediate gear (second gear) 19→intermediate shaft 16→timing belt 18→lower shaft output pulley 15→lower shaft (input shaft) 12→lower shaft input pulley 13→power transmission belt 14→upper shaft output pulley 11→upper shaft 6→rotation transmission mechanism 5*a*→motor 5. A portion where a driving force from the lower shaft (input shaft) 12 is transmitted to the rotation shaft (output shaft) 21 in the above-described transmission path constitutes a transmission mechanism 35 in the present embodiment.

Adjustment of the degree of loosening, i.e., the tension of the timing belt 18 is an important factor for rotation of the motor 5 to be appropriately transmitted to the looper 4. The degree of loosening of the timing belt 18 is adjusted when the timing belt 18 has been elongated due to a secular change or when the timing belt 18 has been replaced in periodic maintenance, for example.

Figure 3:
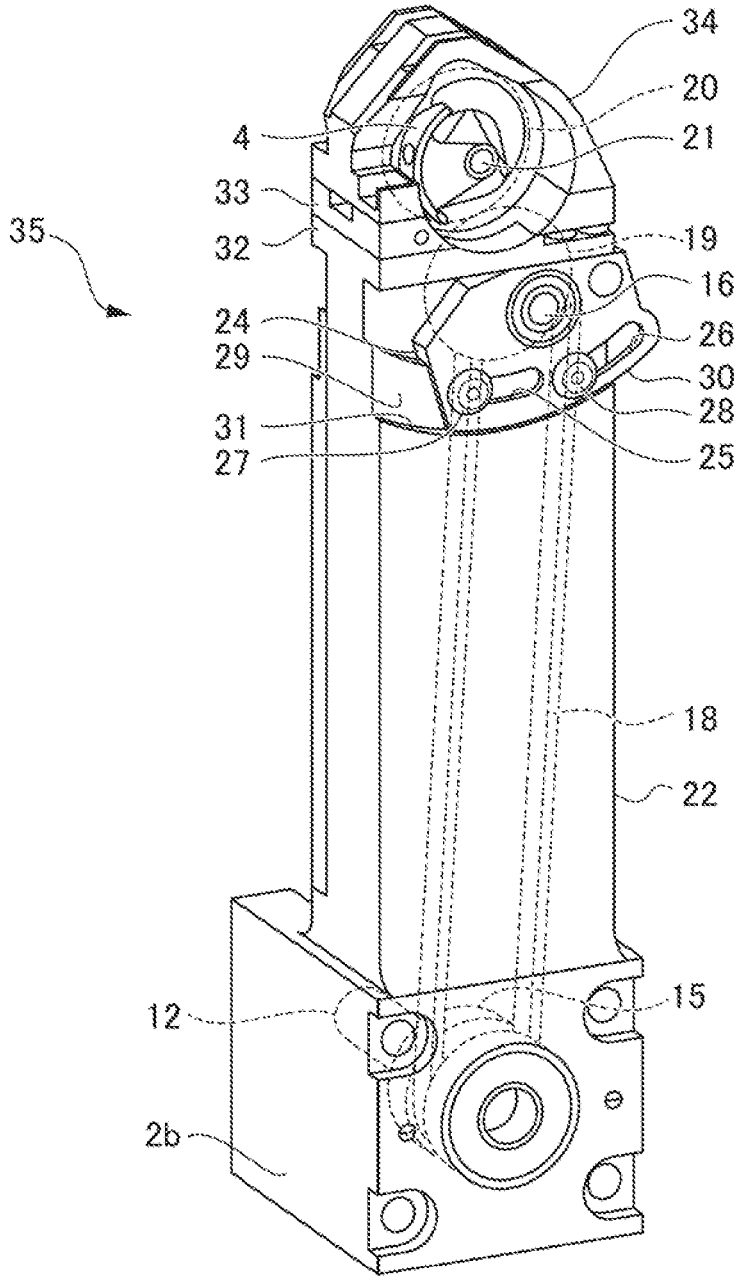
FIG. 3 is a diagram illustrating another state of the driving force transmission mechanism illustrated in FIG. 2.

FIG. 3 is a diagram illustrating another state of the driving force transmission mechanism illustrated in FIG. 2. In FIG. 3, portions corresponding to those illustrated in FIG. 2 are respectively assigned the same reference numerals, and description in FIG. 2 is referred to as appropriate for the portions. In a state illustrated in FIG. 3, the turning support plate 24 is at a limit position where it has turned in a counterclockwise direction in a front view. At this limit position, the first fixing bolt 27 contacts a left end of the first long hole 25, and the second fixing bolt 28 contacts a left end of the second long hole 26.

Even if the turning support plate 24 turns from the position illustrated in FIG. 2 to the position illustrated in FIG. 3, the respective centers of curvature of the first long hole 25 and the second long hole 26 coincide with the axis of the rotation shaft 21. Thus, an inter-axis distance between the driven gear (first gear) 20 in the rotation shaft 21 and the intermediate gear (second gear) 19 in the intermediate shaft. 16 is kept constant. Accordingly, meshing between the driven gear (first gear) 20 and the intermediate gear (second gear) 19 is maintained in a normal state even if the turning support plate 24 moves so that a driving force is transmitted to the rotation shaft 21 that rotates the looper 4 without any difficulty.

Figure 4:
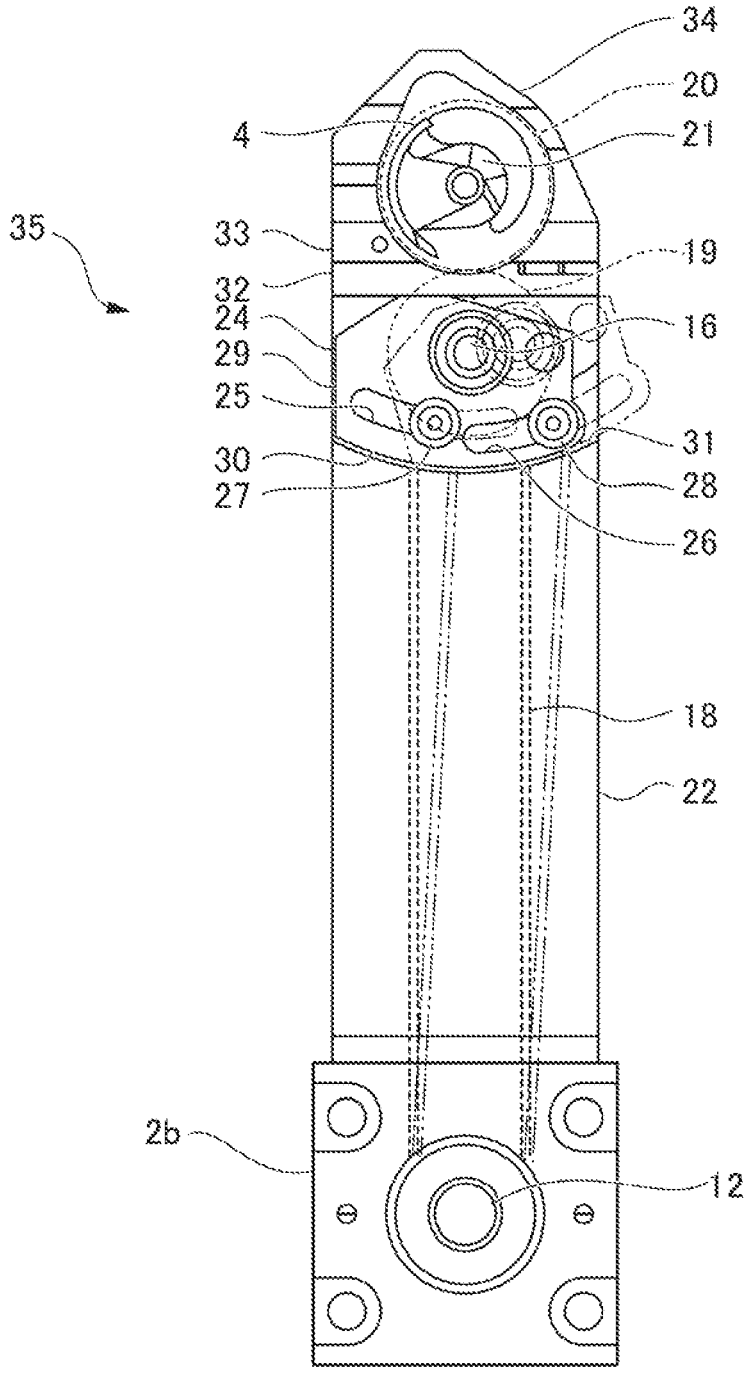
FIG. 4 is a diagram for describing a situation where the driving force transmission mechanism illustrated in FIG. 2 shifts from one state to another state.

FIG. 4 is a diagram for describing a situation where the driving force transmission mechanism illustrated in FIG. 2 shifts from one state to another state. In FIG. 4, portions corresponding to those illustrated in FIG. 2 are respectively assigned the same reference numerals, and description in FIG. 2 is referred to as appropriate for the portions. In FIG. 4, the turning support plate 24 is indicated by a solid line when at a position illustrated in FIG. 2 and is indicated by a two-dot and dash line when at a position illustrated in FIG. 3. The timing belt 18 is indicated by a broken line when at a position illustrated in FIG. 2 and is indicated by a two-dot and dash line when at a position illustrated in FIG. 3. As illustrated, a movable range of the turning support plate 24 is from a first position indicated by the solid line to a second position indicated by the two-dot and dash line to which the turning support plate 24 has turned in a counterclockwise direction in a front view. The inter-axis distance between the lower shaft (input shaft) 12 and the intermediate shaft 16 differs depending on whether the turning support plate 24 is at the first position or at the second position.

That is, as the turning support plate 24 turns from the first position to the second position, the inter-axis distance between the lower shaft (input shaft) 12 and the intermediate shaft 16 increases. That is, the intermediate shaft input pulley 17 in the intermediate shaft 16 moves farther away from the lower shaft output pulley 15 in the lower shaft (input shaft) 12. As a result, the loosening of the timing belt 18 stretched between the lower shaft output pulley 15 and the intermediate shaft input pulley 17 decreases to increase the tension thereof. Accordingly, in a compact configuration in which a tension roller or the like is not provided beside the post bed 22, the loosening of the timing belt 18 can be adjusted without changing respective positions of the lower shaft (input shaft) 12 and the rotation shaft (output shaft) 21.

Figure 5:
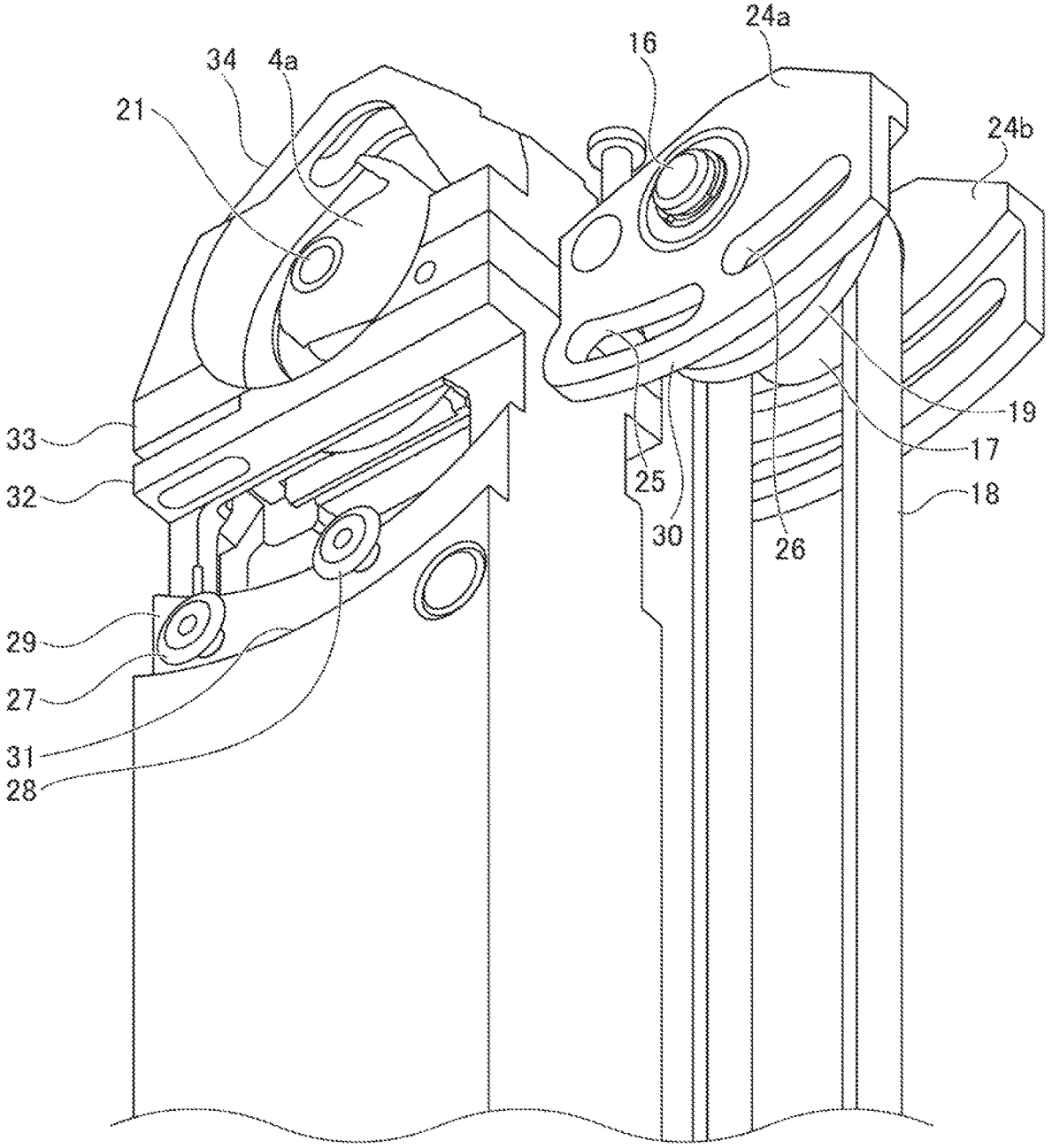
FIG. 5 is a diagram for describing a configuration around a turning support member that supports an intermediate shaft in the driving force transmission mechanism illustrated in FIG. 2.

FIG. 5 is a diagram for describing a configuration around the turning support plate 24 that supports the intermediate shaft 16 in the driving force transmission mechanism illustrated in FIG. 2. In FIG. 5, portions corresponding to those illustrated in FIG. 2 are respectively assigned the same reference numerals, and description in FIG. 2 is referred to as appropriate for the portions. FIG. 5 illustrates how the turning support plate 24 is a pair of a turning support plate 24*a* on one end side of the intermediate shaft 16 and a turning support plate 24*b* on the other end side of the intermediate shaft 16.

In FIG. 5, the pair of turning support plates 24*a* and 24*b* are illustrated by being separated from the attaching portion 29 for convenience of illustration. The turning support plate 24*a* is the above-described turning support plate 24 with reference to FIG. 2. Respective shapes and dimensions in a front view of the turning support plates 24*a* and 24*b* are mirror-symmetrical. The contact surface 30 of the turning support plate 24*a* is an arc-shaped curved surface having a width corresponding to a thickness dimension of the plate-shaped turning support plate 24*a* and having its center of curvature as the axis of the rotation shaft 21.

The first fixing bolt 27 and the second fixing bolt 28 are inserted, corresponding to the first long hole 25 and the second long hole 26, respectively, in the turning support plate 24*a*, and the turning support plate 24*a* is attached to the attaching portion 29 with the first fixing bolt 27 and the second fixing bolt 28.

Figure 6:
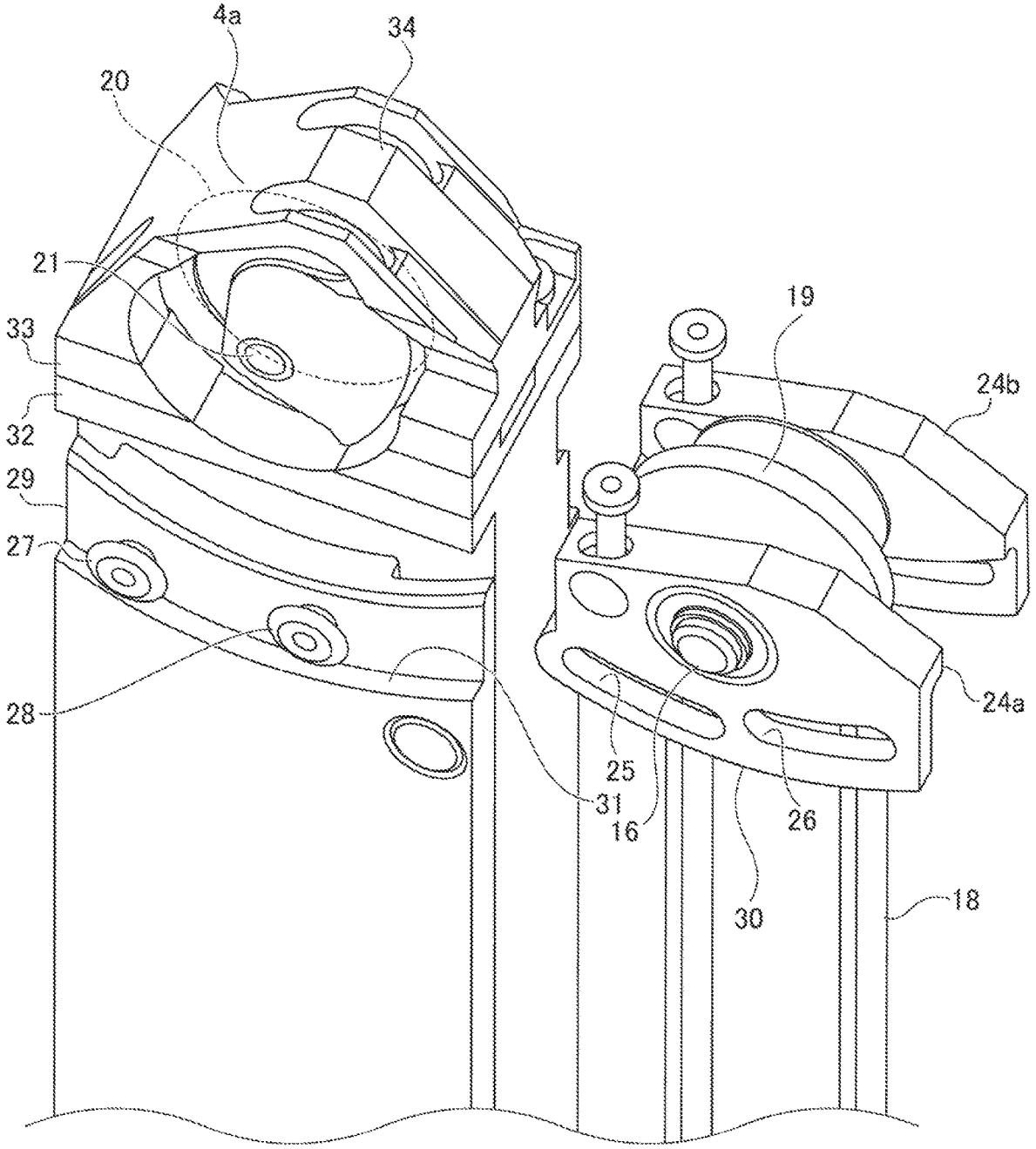
FIG. 6 is a diagram for describing a configuration around a load receiving surface of an attaching portion that attaches the turning support member illustrated in FIG. 5.

FIG. 6 is a diagram for describing a configuration around the load receiving surface 31 of the attaching portion 29 that attaches the turning support plate 24*a* illustrated in FIG. 5. In FIG. 6, portions corresponding to those illustrated in FIG. 2 are respectively assigned the same reference numerals, and description in FIG. 2 is referred to as appropriate for the portions. A center of curvature of the load receiving surface 31 curved in an arc shape of the attaching portion 29 is the axis of the rotation shaft 21, and coincides with the center of curvature of the curved contact surface 30 of the turning support plate 24*a*.

That is, the load receiving surface 31 is curved in a circular arc shape along the contact surface 30 of the turning support plate 24*a*. Accordingly, the load receiving surface 31 contacts the contact surface 30 of the turning support plate 24*a* with no clearance to support the turning support plate 24*a* even if the turning support plate 24*a* is at any movement position when turning around the axis of the rotation shaft 21. The same applies to the turning support plate 24*b*. Accordingly, the turning support plates 24*a* and 24*b* can be reliably supported by the load receiving surface 31 even if their respective loads increase upon change in the tension of the timing belt 18 to resist the loads.

The sewing device and the looper positioning method according to the present embodiment have the following effects.

The sewing device 1 described in the item (1) includes the motor 5 as a power source, the lower shaft 12 as an input shaft to which a driving force from the motor 5 is transmitted, the rotation shaft 21 as an output shaft that outputs the driving force transmitted to the lower shaft 12, and the transmission mechanism 35 that transmits the driving force from the lower shaft. 12 to the rotation shaft 21. The transmission mechanism 35 includes the driven gear 20 as the first gear that is provided in the rotation shaft 21 and rotates integrally with the rotation shaft 21, the intermediate gear 19 as the second gear that meshes with the driven gear 20, the intermediate shaft 16 that rotates integrally with the intermediate gear 19, and the timing belt 18 stretched between the lower shaft 12 and the intermediate shaft 16. The intermediate gear 19 is disposed to be movable in a circumferential direction of the driven gear 20. Loosening (tension) of the timing belt 18 can be adjusted by changing an inter-axis distance between the lower shaft 12 as the input shaft and the intermediate shaft 16 with meshing between the driven gear 20 as the first gear and the intermediate gear 19 as the second gear maintained. In the case of the adjustment, respective positions of the lower shaft 12 as the input shaft and the rotation shaft 21 as an output shaft do not change. The sewing device 1 can be made compact because it is configured such that a tension roller or the like is not required to adjust the tension of the timing belt 18 and the position of the lower shaft 12 as the input shaft does not change.

The sewing device 1 described in the item (2) further includes the turning support plates 24, 24*a*, and 24*b* as the support member that supports the intermediate shaft 16 at its end portion, the first fixing bolt 27 and the second fixing bolt 28 provided in one of the turning support plates 24, 24*a*, and 24*b* and the predetermined attaching portion 29 that attaches the turning support plates 24, 24*a*, and 24*b*, the fixing bolt being disposed to fix the turning support plates 24, 24*a*, and 24*b* to the attaching portion 29, and the first long hole 25 and the second long hole 26 as circular arc-shaped long holes provided in the other of the turning support plates 24, 24*a*, and 24*b* and the attaching portion 29, the first fixing bolt 27 and the second fixing bolt 28 being inserted in the first long hole 25 and the second long hole 26, the first long hole 25 and the second long hole 26 having their own centers of curvature coinciding with a rotation center of the driven gear 20 as the first gear. The turning support plates 24, 24*a*, 24*b* are attached to the attaching portion 29 to be turnable with the respective centers of curvature of the first long hole 25 and the second long hole 26 as their axes. Accordingly, when the turning support plates 24, 24*a*, and 24*b* are moved along the first long hole 25 and the second long hole 26, the tension of the timing belt 18 can be easily adjusted by changing an inter-axis distance between the lower shaft output pulley 15 in the lower shaft (input shaft) 12 and the intermediate shaft input pulley 17 in the intermediate shaft 16.

In the sewing device 1 described in the item (3), the turning support plates 24, 24*a*, and 24*b* as the support member have the circular arc-shaped contact surface 30 having its own center of curvature coinciding with a rotation center of the driven gear 20 as the first gear in the lower shaft 12 side as the input shaft, and the attaching portion 29 has the load receiving surface 31 that is formed in a circular arc shape having its own center of curvature coinciding with the rotation center of the driven gear 20 and slidably contacts the contact surface 30. Accordingly, the turning support plates 24, 24*a*, and 24*b* can sufficiently resist a load due to change in the tension of the timing belt 18 by the load receiving surface 31 of the attaching portion 29.

Although the embodiment of the present invention has been described above, the present invention is not limited to this. A configuration of details may be appropriately changed within the spirit of the present invention. Although in the above-described embodiment, the turning support plates 24*a* and 24*b* are provided with the first long hole 25 and the second long hole 26, respectively, and the attaching portion 29 is provided with the first fixing bolt 27 and the second fixing bolt 28, for example, the turning support plates 24*a* and 24*b* may be provided with the first fixing bolt 27 and the second fixing bolt 28, respectively, and the attaching portion 29 may be provided with the first long hole 25 and the second long hole 26. In this case, when the turning support plate 24, 24*a*, and 24*b* are moved along the first long hole 25 and the second long hole 26 provided on the attaching portion 29 side, tension of the timing belt 18 can also be easily adjusted.

EXPLANATION OF REFERENCE NUMERALS

1 . . . Sewing device
2 . . . Sewing device main body
2*a* . . . Arm portion
2*b* . . . Bed portion
3, 3*a*, 3*b* . . . Needle
4, 4*a*, 4*b* . . . Looper
5 . . . Motor
5*a* . . . Rotation transmission mechanism
6 . . . Upper shaft
7 . . . Crank mechanism
8 . . . Motion conversion mechanism
9 . . . Sliding rod
10 . . . Needle holder
11 . . . Upper shaft output pulley
12 . . . Lower shaft (input shaft)
13 . . . Lower shaft input pulley
14 . . . Power transmission belt
15 . . . Lower shaft output pulley
16 . . . Intermediate shaft
17 . . . Intermediate shaft input pulley
18 . . . Timing belt

19 . . . Intermediate gear (second gear)
20 . . . Driven gear (first gear)
21 . . . Rotation shaft (output shaft)
22 . . . Post bed
23 . . . Mount
24, 24*a*, 24*b* . . . Turning support plate (support member)
25 . . . First long hole
26 . . . Second long hole
27 . . . First fixing bolt
28 . . . Second fixing bolt
29 . . . Attaching portion
30 . . . Contact surface
31 . . . Load receiving surface
32 . . . Flat portion
33 . . . Base portion
34 . . . Casing
35 . . . Transmission mechanism

What is claimed is:

1. A sewing device comprising a sewer that forms stitches in a workpiece to be sewed, the sewing device comprising:

a power source;

an input shaft to which a driving force from the power source is transmitted;

an output shaft that outputs the driving force transmitted to the input shaft; and a transmitter that transmits the driving force from the input shaft to the output shaft, wherein the transmitter comprises a first gear that is provided in the output shaft and rotates integrally with the output shaft, a second gear that meshes with the first gear, an intermediate shaft that rotates integrally with the second gear, and a timing belt stretched between the input shaft and the intermediate shaft, wherein the second gear is disposed to be movable in a circumferential direction of the first gear.

2. The sewing device according to claim 1, further comprising:

a support member that supports the intermediate shaft at its end portion;

a fixing bolt in one of the support member and a predetermined attaching portion that attaches the support member, the fixing bolt being disposed to fix the support member to the attaching portion; and a circular arc-shaped long hole in the other of the support member and the attaching portion, the fixing bolt being inserted in the circular arc-shaped long hole and the circular arc-shaped long hole having its own center of curvature coinciding with a rotation center of the first gear;

wherein the support member is attached to the attaching portion to be turnable with the center of curvature of the long hole as its axis.

3. The sewing device according to claim 1, further comprising:

a support member that supports the intermediate shaft at its end portion;

a fixing bolt in one of the support member and a predetermined attaching portion that attaches the support member, the fixing bolt being disposed to fix the support member to the attaching portion, and a circular arc-shaped long hole in the other of the support member and the attaching portion, the fixing bolt being inserted in the circular arc-shaped long hole, the circular arc-shaped long hole having its own center of curvature coinciding with a rotation center of the first gear wherein the support member is attached to the attaching portion to be turnable with the center of curvature of the long hole as its axis and, furthermore, has a circular arc-shaped contact surface having its own center of curvature coinciding with the rotation center of the first gear, in the input shaft side, and the attaching portion has a load receiving surface that is formed in a circular arc shape having its own center of curvature coinciding with the rotation center of the first gear and slidably contacts the contact surface.

* * * * *